United States Patent [19]

Winter et al.

[11] 4,069,358

[45] Jan. 17, 1978

[54] METHOD FOR CLADDING HEAVY GAGE PLATE

[75] Inventors: Joseph Winter, New Haven; Derek E. Tyler, Cheshire, both of Conn.

[73] Assignee: Olin Corporation, New Haven, Conn.

[21] Appl. No.: 653,094

[22] Filed: Jan. 28, 1976

[51] Int. Cl.[2] ..... C23C 1/10

[52] U.S. Cl. ..... 427/319; 427/329; 427/310; 427/209; 427/432; 427/434 A; 427/434 C; 118/410; 118/300

[58] Field of Search ..... 427/328, 329, 430 R, 427/431, 432, 434 C, 434 A, 436, 287, 256, 209, 310, 319; 118/300, 400, 410, 421, 429; 29/196.3

[56] References Cited

U.S. PATENT DOCUMENTS

| | | | |
|---|---|---|---|
| 2,445,372 | 7/1948 | Trenbath | 29/196.3 |
| 3,184,331 | 5/1965 | Carter | 427/431 X |
| 3,217,959 | 11/1967 | Di Renzo | 118/429 |
| 3,303,983 | 2/1967 | Patrick et al. | 118/410 |
| 3,724,418 | 4/1973 | McLain | 118/429 |
| 3,773,242 | 11/1973 | Fitzsimmons | 118/400 |
| 3,941,088 | 3/1976 | Ronafoldi et al. | 118/620 |

*Primary Examiner*—Ralph S. Kendall

*Attorney, Agent, or Firm*—Robert H. Bachman; Robert A. Dawson

[57] ABSTRACT

A method of cladding metal plate with a protective layer of copper or copper base alloy is disclosed. The metal plate is contacted with a standing waveform of molten copper or copper base alloy in order to provide the cladding layer. This clad composite material is used to provide corrosion resistance for the metal plate substrate and an inexpensive alternative to solid thick sheets of copper or copper base alloy to deter corrosion.

13 Claims, No Drawings

METHOD FOR CLADDING HEAVY GAGE PLATE

BACKGROUND OF THE INVENTION

Significant success has been achieved in both energy consumption and craft utilization when boats are made of copper or copper base alloy clad metal plate. The copper or copper base alloy provides excellent corrosion resistance while the cladding material decreases the cost of using thick monolithic copper or copper base alloy sheets to provide this corrosion resistance. For example, cupronickel alloys, particularly Copper Development Association (CDA) Alloys 706, 715 and 722, have been acknowledged as superior construction materials in structures subjected to the corrosive effects of salt water. Significant success has been achieved in the use of CDA Alloy 706 as plate material for shrimp boat hulls.

Copper and copper base alloys have also been used in tube sheets for condensers used in both desalinization and power generation plants, in clad pipe for the inlets of cooling water ducts, in off-shore structures and in other chemical processing or marine fouling applications.

Solid monolithic cupro-nickel alloy, for example, is very expensive when used for the applications outlined above. Furthermore, this material is usually not structurally acceptable for large ships and certain large tube sheet applications because of the low modulus of the cupro-nickel alloy.

These problems are generally overcome by using the cupro-nickel alloy as a clad plate product wherein the cupro-nickel alloy surface represents about 10% by thickness of the clad plate when mild steel plate is used as the substrate. The substrate provides strength and the cladding provides corrosion resistance at lower cost than the monolithic material. The clad plate product is also quite useful even for those applications where the monolithic cupro-nickel alloy may be successfully used because the clad plate cost is substantially lower than that of cupro-nickel alloy of the same thickness.

Many approaches to achieving large size copper or copper base alloy clad plate have been studied. These approaches include solid state bonding such as hot rolled bonding and explosive bonding of solid sheets of copper or copper base alloy to the metal plate substrate. Liquid phase bonding has also been studied in procedures employing metal spraying and direct casting in line. Wave-soldering procedures are already known for cladding lead-tin alloys onto copper or copper base alloys. Metal coating processes are also known in which the substrate metal is immersed in a molten bath of another metal or alloy.

Those procedures which depend upon solid state bonding of solid copper or copper base alloy sheets are severely limited by the availability of wide copper or copper base alloy sheets or coils. Since ship builders prefer wide plate in the manufacture of hulls, decks and accoutrements, this width limitation imposed by the copper industry capabilityaccentuates the problems of welding procedures to join the narrow plates being worked upon.

Those procedures which depend upon liquid phase bonding of the copper base alloy to the metal substrate face financial limitations imposed by very expensive energy requirements. Another problem imposed by the liquid phase bonding is the inherent surface non-uniformity of the clad material deposited on the substrate by the process. The casting techniques present their own problems since the economics of casting require that the operation be conducted at greater thicknesses than ultimately desired in the cladding material. Accordingly, the composite clad plate must then be rolled on a plate mill to the desired finish gage. Since copper or copper base alloy melting is not usually done in an iron or iron alloy plate mill and since brass or copper mills normally do not have wide plate mills, the casting technique for applying the copper or copper base alloy cladding material would necessitate significant shipping costs and result in large amounts of useless scrap material.

SUMMARY OF THE INVENTION

The present invention resides in a method of cladding metal plate with copper or copper base alloy wherein the cladding is accomplished through the use of a molten bath of the alloy. The metal plate is contacted with the surface of the molten bath of the cladding metal and is not immersed in the molten material. The copper or copper base alloy is preferably one which possesses high corrosion resistance.

It is an object of the present invention to disclose a process of cladding metal plate with a corrosion resistant copper or copper base alloy layer.

It is a further object of the present invention to disclose a process in which metal plate is contacted with a molten copper or copper base alloy in a manner which precludes immersion of the plate in the molten metal.

It is yet a further object of the present invention to disclose a method of producing inexpensively clad metal plate.

Further objects and advantages of the present invention will appear from the ensuing specification.

DETAILED DESCRIPTION

The present invention consists of a process of contacting a surface of a metal plate with a molten copper or copper base alloy. This contacting step is performed by using a bath of molten copper or copper base alloy in which the metal plate is not immersed. The surface of the molten metal is in the form of a standing wave.

The composite clad metal plate produced by the present invention may be achieved by passing the metal plate, which is maintained at a temperature below the melting point of the copper or copper base alloy which contacts the surface of the metal plate, over a standing waveform of the molten copper or copper base alloy. The cladding metal, upon contacting the cooler metal plate, solidifies and adheres to the metal plate, thereby achieving the composite clad plate. The thickness of the copper or copper base alloy component of the composite may be maintained by control of the dependent variables of gage, temperature and speed of the metal plate and by imposition of an appropriate roll wipe, scrape or shave apparatus, which is located behind the standing wave of molten metal.

The standing wave of molten copper or copper base alloy may be achieved in a variety of ways. A wave of molten metal may be made without the use of pumps by inducing a self-generated pumping action in the molten metal bath through the use of electromagnetic, mechanical or motor effect induction. The standing wave may also be made through the use of pressure applied over the molten metal tank thus forcing a syphon effect or through the use of surface tension as induced by a shaped column or by some combination of the above described methods.

It is usually appropriate to incorporate some sort of surface treatment step in the process of the present invention in order to prepare the surface of the plate which is to be contacted by the standing wave of molten metal. This may be accomplished before the preheating step through the use of a flux or salt bath appropriate for the particular metal of the plate. It may also be appropriate to provide some sort of protective atmosphere of relatively inert gas around the treated metal before contact with the molten standing wave in order to prevent surface oxidation from interfering with the adhesion of the applied metal layer. Means well known in the metal treating and coating art may be utilized to provide the appropriate treating and protective atmosphere steps. It is critical that a clean metal plate surface be presented to the molten metal coating station in order to provide the best possible corrosion resistance in the clad plate product produced by the process of the present invention.

Metals which may be utilized for the substrates of the present invention include iron and iron alloys. Particularly preferred as substrate materials are the structural or drawing grades of hot rolled steel plate. The substrate material is preferably utilized in plate form, with the plate thickness ranging from one-eighth to two inches. The substrate plate thickness is preferably approximately one inch.

Metals which may be utilized as the cladding material include copper and copper base alloys. Particularly preferred are alloys of copper and nickel, which are generally known as cupro-nickel alloys, such as Copper Development Association (CDA) Alloys 706, 715 and 722. The copper base alloys known as admiralty brasses and bronzes are also contemplated as cladding materials within the scope of the present invention, depending upon the intended use of the clad plate. The thickness of the cladding will generally range from 0.01 to 0.5 inches, preferably 0.1 to 0.5 inches. It is particularly preferred to have the cladding thickness equal approximately 10% of the total thickness of substrate plus cladding.

The process of the present invention starts with the depositing of the cladding metal in a vat arrangement, preferably surrounded by heating means. These heating means may alone serve to provide the standing wave of molten cladding metal or the heating means may be used in conjunction with an external wave-forming means, such as a shaped column utilized with or without the application of external pressure to the molten metal surface.

The substrate plate is passed through a surface treatment station in order to clean the plate and remove any oxidation, scales or other irregularities. The plate is then passed to a preheating station, which may consist of a heated table or other known heating means, in order to heat the plate to a temperature below that of the molten cladding material in the vat. This temperature may range from 200 to 1000° C, with a preferred range between 600° - 800° C. The temperature of the molten bath will generally range from 1100° to 1400° C, preferably from 1100° to 1250° C.

The cleaned and heated substrate plate is next passed over the standing wave of cladding metal and contacts only the top portion of the standing wave, in accordance with any preferred thickness requirements. The plate is passed over the standing wave at a speed generally ranging from 2 to 40 in./minute, with 5 to 25 in./minute being preferred. The heated substrate plate may contact the standing wave of cladding metal in one pass or in multiple passes, depending upon the thermodynamic balance of the entire cladding system. Thus the speed of the heated plate over the standing wave, the temperatures of the plate and the bath and the thickness of both substrate and cladding are all related to the entire thermodynamic balance of the system.

The composite clad plate is finally passed to an unloading station where it is taken off the cladding line and is used in any desired form. This entire cladding process may take place in a conveyor-type apparatus so as to provide a continuous cladding operation. Instead of contacting only one side of the substrate plate with the cladding metal, it may be desirable to pass a clad plate through the process again in order to provide a second clad surface on the metal substrate. , The present invention will be made clear through reference to the following illustrative example.

EXAMPLE

A bath of molten copper-nickel alloy (CDA Alloy 706) was prepared and held at 1200° C in a 4000 cps induction heated clay graphite crucible. The induction frequency was adjusted to elevate the alloy melt and provide a ½ inch high meniscus. A precleaned 6 inches long, 1 inch wide, ½ inch thick piece of steel (SAE Alloy No. 1020) was preheated to 700° C in a protective argon atmosphere. The heated metal strip was pulled across the copper-nickel alloy meniscus at approximately 3 in./minute. A layer of copper-nickel alloy approximately 0.1 inch thick was consequently clad onto the steel alloy substrate plate.

It is to be understood that the invention is not limited to the illustration described and shown herein, which is deemed to be merely illustrative of the best modes of carrying out the invention, and which is suitable of modification of form, size, arrangement of parts and details of operation. The invention rather is intended to encompass all such modifications which are within its spirit and scope as defined by the claims.

What is claimed is:

1. A method of cladding plate comprising the steps of:

a. providing a clean, smooth metal substrate in plate form having a thickness of from ⅛ to 2 inches selected from the group consisting of iron and iron alloys;

b. heating the plate to a temperature between 200° and 1000° C;

c. providing a bath of molten metal cladding material selected from the group consisting of copper and copper base alloys at a temperature above that of the heated substrate plate, wherein the temperature of said metal cladding material ranges from 1100° to 1400° C;

d. forming a standing wave of the molten metal in the bath;

e. contacting at least one surface of the heated substrate plate with the top portion of the standing wave of molten cladding material in at least one pass through the contacting station to form a composite clad plate wherein the cladding thickness ranges from 0.01 to 0.5 inch, wherein the substrate plate contacts the standing wave of cladding material at a speed ranging from 2 to 40 inches per minute; and f. removing the composite clad plate from the contacting station, to be subsequently formed if desired.

2. A process as in claim 1 wherein the substrate metal is selected from the group consisting of structural and drawing grades of hot rolled steel plate.

3. A process as in claim 1 wherein the cladding material is a copper-nickel alloy.

4. A process as in claim 1 wherein the substrate plate, before contacting the molten cladding material, is surrounded by a protective atmosphere of inert gas.

5. A process as in claim 1 wherein the substrate plate is passed through a surface treatment station to further clean the plate and remove any oxidation or other irregularities on the plate surface before being heated.

6. A process as in claim 1 wherein the substrate plate is heated to a temperature between 600° and 800° C.

7. A process as in claim 1 wherein the temperature of the molten cladding material ranges from 1100° to 1250° C.

8. A process as in claim 1 wherein the standing wave of molten cladding material is formed by the application of pressure over at least a portion of the molten metal surface.

9. A process as in claim 1 wherein the substrate plate contacts the standing wave of cladding material at a speed ranging from 5 to 25 inches per minute.

10. A method according to claim 1 wherein said standing wave is formed by inducing a self-generated pumping action in the molten metal bath.

11. A method according to claim 1 wherein the cladding thickness ranges from 0.1 to 0.5 inch.

12. A method according to claim 1 wherein said bath of molten metal cladding material is provided in a vat surrounded by heating means.

13. A method according to claim 1 wherein said cladding is formed on both sides of said plate.

* * * * *